US011670827B2

(12) United States Patent
Lafergola et al.

(10) Patent No.: US 11,670,827 B2
(45) Date of Patent: Jun. 6, 2023

(54) WAVEGUIDE SWITCH

(71) Applicants: John Lafergola, Sheffield, AL (US); Paul Jenkins, Wilmington, DE (US)

(72) Inventors: John Lafergola, Sheffield, AL (US); Paul Jenkins, Wilmington, DE (US)

( * ) Notice: Subject to any disclaimer, the term of this patent is extended or adjusted under 35 U.S.C. 154(b) by 210 days.

(21) Appl. No.: 17/303,152

(22) Filed: May 21, 2021

(65) Prior Publication Data

US 2021/0367312 A1 Nov. 25, 2021

Related U.S. Application Data

(60) Provisional application No. 62/704,669, filed on May 21, 2020.

(51) Int. Cl.
*H01P 1/10* (2006.01)
*H01P 1/12* (2006.01)

(52) U.S. Cl.
CPC ..... *H01P 1/122* (2013.01)

(58) Field of Classification Search
CPC .. H01P 1/122; H01P 1/10; H01P 1/062; H01P 1/063; H01P 1/064; H01P 1/065; H01P 1/066; H01P 1/067
See application file for complete search history.

(56) References Cited

U.S. PATENT DOCUMENTS 6,667,671 B1 * 12/2003 Speldrich ..... H01P 1/122 333/108
9,793,588 B2 * 10/2017 Kawamura ..... H01P 1/10
11,239,535 B2 * 2/2022 Hollenbeck ..... H01P 3/12

* cited by examiner

*Primary Examiner* — Hai L Nguyen

(57) ABSTRACT

The present disclosure refers to a waveguide electromechanical relay switch having a rotor with transmission paths and an axis of rotation parallel to the base plane combined with an actuator adapted to the configuration. A 4-pol switch design enables compensation of fault cases in a relatively shortened length of transmission line, reducing potential RF loss. In one embodiment, a 4-pol rotor includes an offset transmission path that enables crossing of another path on the same rotor, providing increased functionality and fault-case recovery.

7 Claims, 25 Drawing Sheets

100

100

200

200

221

300

300

321

321

400

400

421

421

400

400

400

400

400

500

500

600

600

700

700

WAVEGUIDE SWITCH

TECHNICAL FIELD

The present invention relates generally to the field of waveguide electromechanical relay switches, and more specifically to electromechanical relay switches for transmitting radio frequency (RF) signals.

BACKGROUND

An electromechanical waveguide relay switch routes signals through transmission paths with a high degree of efficiency. Radio frequency (RF) and microwave switches are used in microwave systems for signal routing along designated paths between RF components, and between RF components and antennas. Switches in a matrix enable the routing of signals from multiple components to single or multiple units. Switches comprising a switch matrix enable the routing of signals from single or multiple inputs to single or multiple outputs.

In some applications, redundant or spare equipment is included in the system and is configured to be switched in or out of the system to account for failures to one or more unit(s). In such a case, redundant units are built into the system so that, in the event of a failure, the failed unit is switched out of the RF path and a redundant unit is switched into the path.

SUMMARY

The present disclosure refers to a waveguide electromechanical relay switch having a rotor with transmission paths and an axis of rotation parallel to the base plane. The configuration allows for a small footprint. A 4-pol switch design enables compensation of fault cases in a relatively shortened length of transmission line, reducing potential RF loss. In one embodiment, a 4-pol rotor includes an offset transmission path that enables crossing of another path on the same rotor, providing increased functionality and fault-case recovery.

An axis of rotation parallel to the base plane is referred to here as a horizontal axis of rotation. One skilled in the art understands that if the base plane is mounted on a vertical surface, the axis of rotation parallel to the base plane of the switch may be seen to be vertical.

In an example embodiment, electro-magnet actuator(s) in combination with permanent magnets are used to actuate a rotor, and the permanent magnets latch the rotor. An electro-magnet actuator has only one moving part and is controlled by short, timed pulses of current to energize the magnet(s) in a specific order and duration, causing the rotor to rotate. Reversing the current direction for the electromagnets reverses the actuation direction.

One skilled in the art is familiar with actuation machinery and understands that stepper motors, solenoids, electro-magnets and the like are commonly used for actuating moving components. Iterations of the instant embodiment are shown here with electro-magnet actuators for clarity. One skilled in the art understands that other methods and apparatus may be used to actuate an example rotor of the present embodiment.

DESCRIPTION

Figure 1:
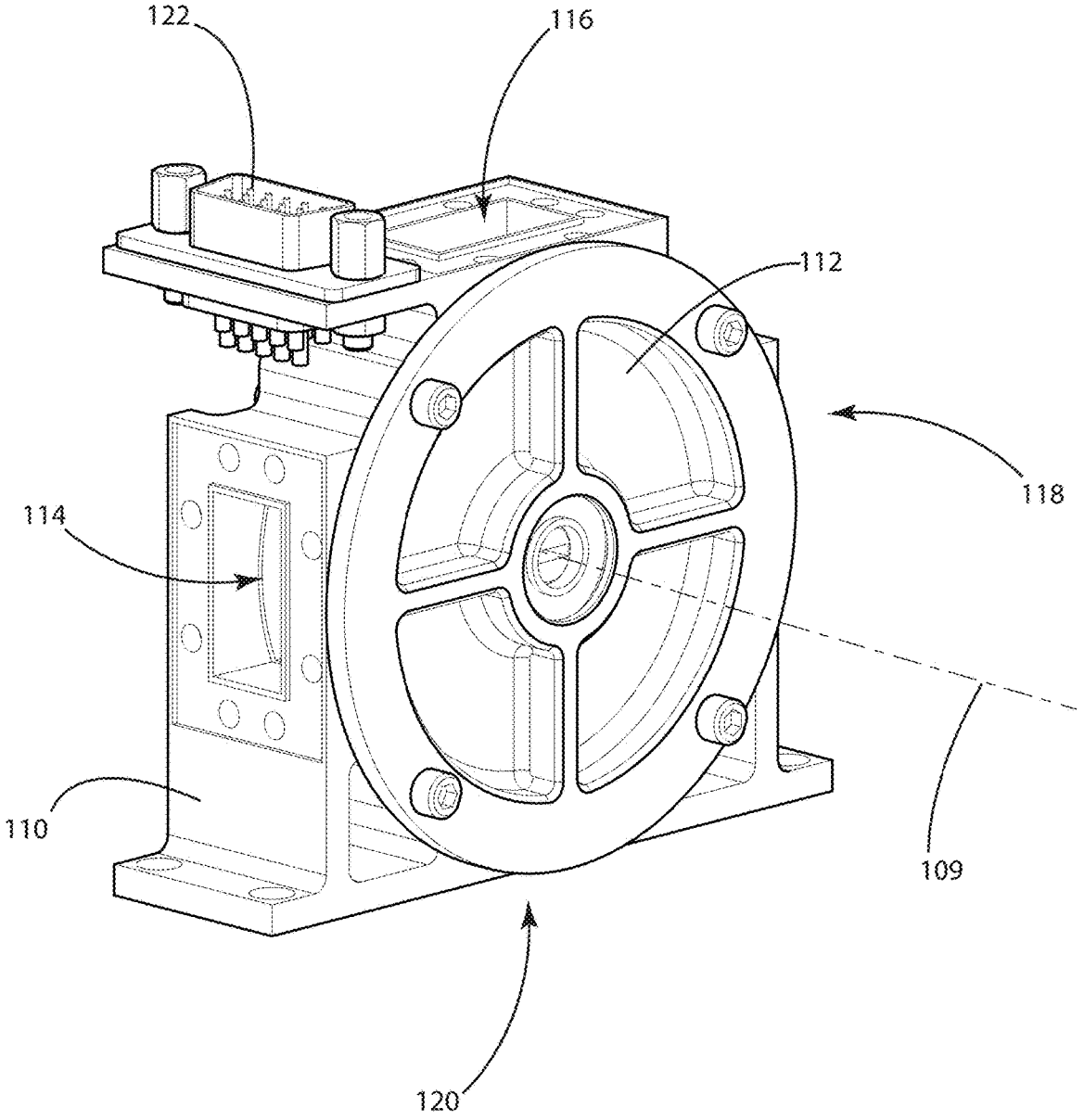
FIG. 1 is a front-perspective view of an example embodiment of a 2-pol design.

In FIG. 1, an example embodiment 100 of a waveguide switch has a frame 110 with transmission-path ports 114, 116, 118 and 120. Ports 118 and 120 are visible in FIG. 2. One skilled in the art understands that similar perpendicular ports may reside on any side of a frame such as frame 110. A cover 112 contains a rotor 121 (FIG. 2) that rotates about a horizontal axis 109. An electrical port 122 communicates with a processor for telemetry and actuation, measuring the orientation of the rotor 121 (FIG. 2) and for actuating electromagnets 131.

Figure 2:
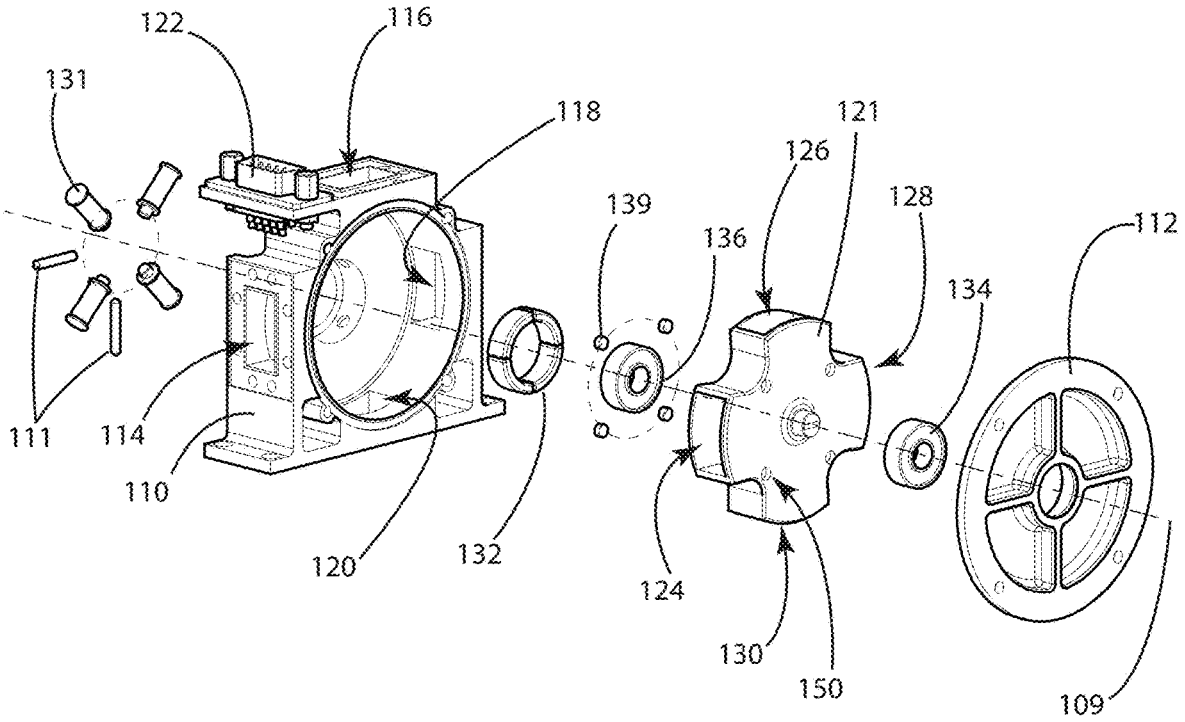
FIG. 2 is a front-perspective, exploded view of an example embodiment of a 2-pol design.

Dashed lines in FIG. 2 group components that are arranged in an array. An array may be any number of components arranged in a pattern. An example is an array of four permanent magnets 139 that are joined by a dashed line.

Figure 3A:
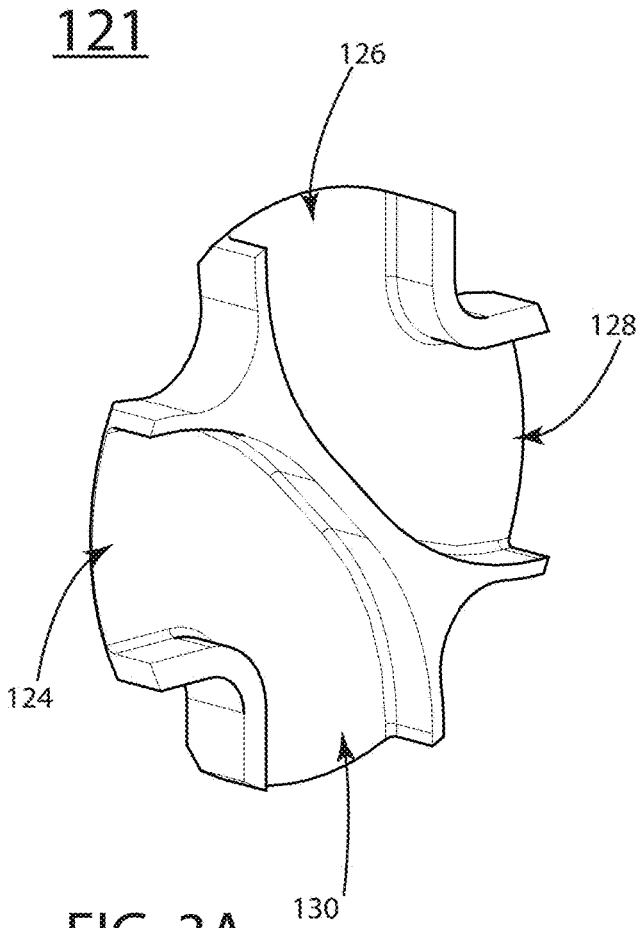
FIG. 3A is a perspective, section view of an example 2-pol rotor.
Figure 3B:
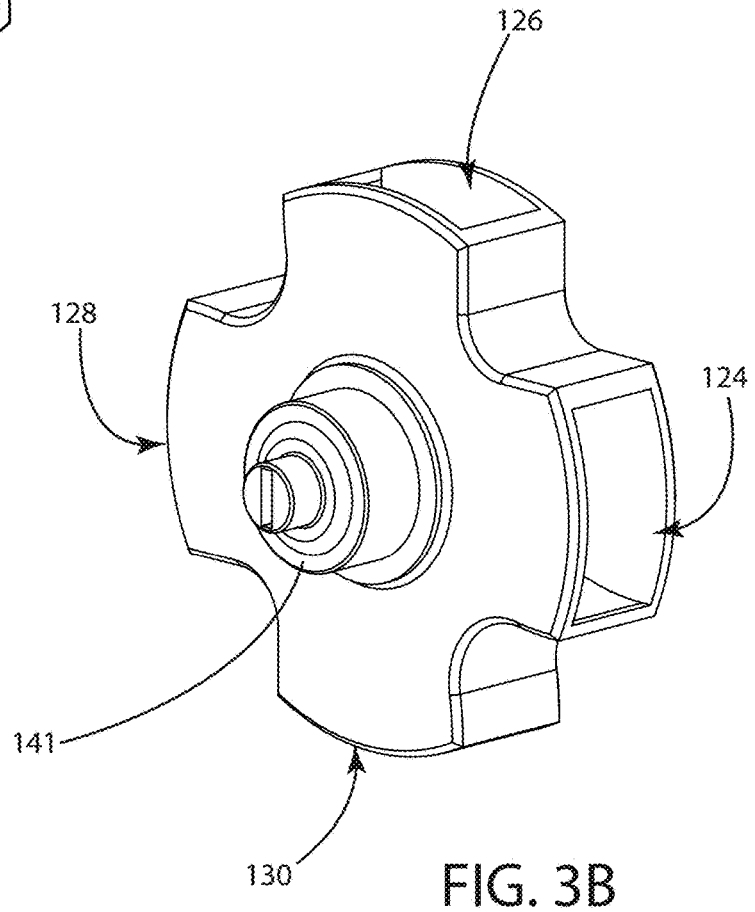
FIG. 3B is a perspective, rear view of an example 2-pol rotor.

Referring to FIG. 2 and FIGS. 3A and 3B: FIG. 2 is an exploded view of the example embodiment in FIG. 1. FIG. 3A is a perspective, cross-section view of a rotor 121. FIG. 3B is a perspective view of the rear of the rotor 121 showing a boss 141. The rotor 121 has transmission-path openings 124, 126, 128 and 130 that align, in one configuration, with transmission-path ports 114, 116, 118 and 120. In an example embodiment, a transmission path resides between openings 124 and 130 while a second transmission path resides between openings 126 and 128. An array of electromagnets 131 are attached to the frame (also referred to as housing) 110. When energized, the electromagnets interact with an array of permanent magnets 132 which are attached to boss 141 on the rotor 121 (FIG. 3B). Controller signals through electrical port 122 control electrical impulses to the electromagnets 131 that act on the array of permanent magnets 132 to rotate the rotor. One skilled in the art understands that use of electromagnets in conjunction with permanent magnets, placed on a rotor of the disclosed embodiment and iterations, essentially renders the switch a motor with RF paths embedded in it as opposed to a switch using a separate motor or actuator typical of the state of the art. One skilled in the art understands how energizing and switching the polarity of electromagnets 131 to attract or repel magnets in the array 132 may effectively spin the rotor 121.

An array of magnets 139 are attached to the boss area on the rear of the rotor 121. The array of magnets 139 aligns with the reed switches 111 housed in the frame 110. Magnets 139 in the array flip reed switches 111 when in close proximity. One skilled in the art understands how the movement of magnets past the reed switches 111 flips each reed switch, signaling the relative rotational position of the rotor 121.

Figure 4:
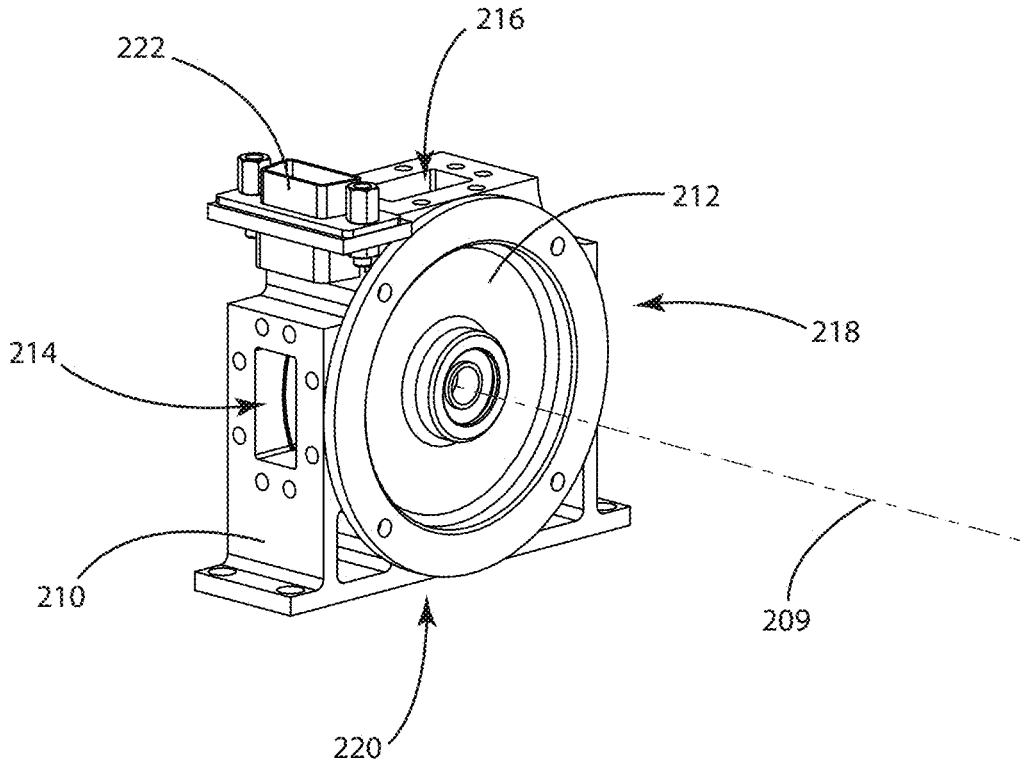
FIG. 4 is a front-perspective view of an example embodiment of a 2-pol design.

In FIG. 4, an example embodiment 200 of a waveguide switch has a frame 210 with transmission-path ports 214, 216, 218 and 220. Ports 218 and 220 are visible in FIG. 5. One skilled in the art understands that similar perpendicular ports may reside on any side of a frame such as frame 210. A cover 212 contains a rotor 221 (FIG. 5) that rotates about a horizontal axis 209. An electrical port 222 communicates with a processor for telemetry and actuation, measuring the orientation of the rotor 221 (FIG. 5) and for actuating electromagnets 231.

Figure 5:
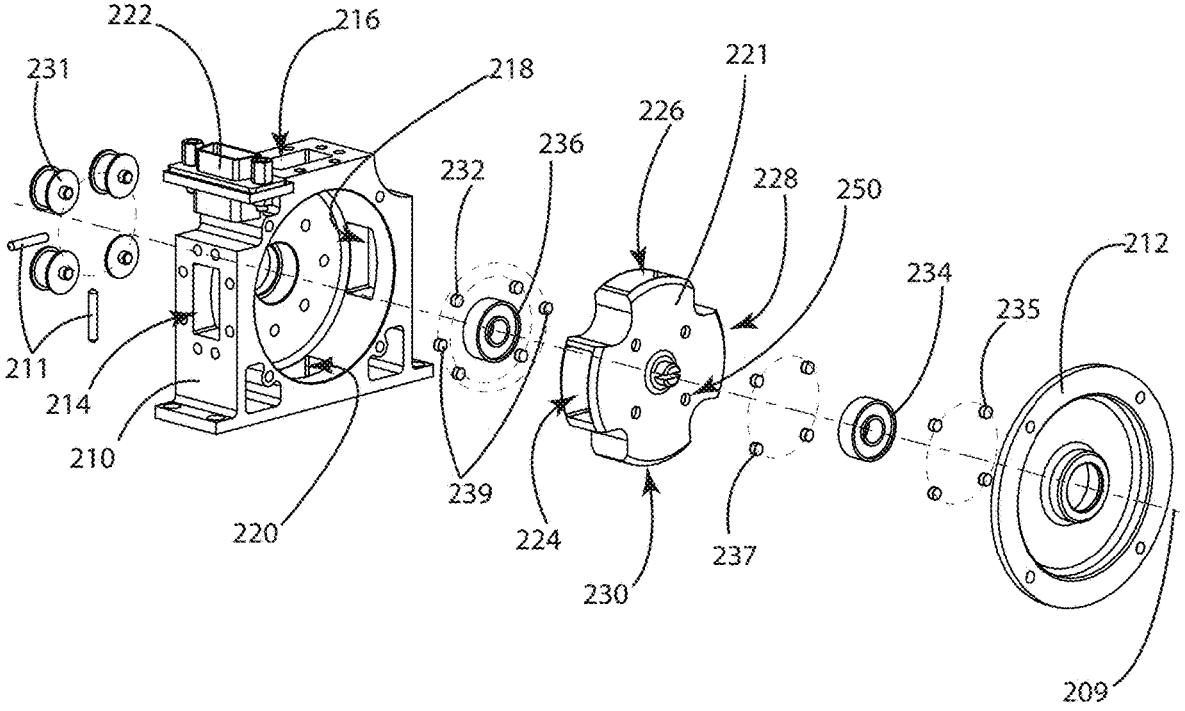
FIG. 5 is a front-perspective, exploded view of an example embodiment of a 2-pol design.
Figure 6:
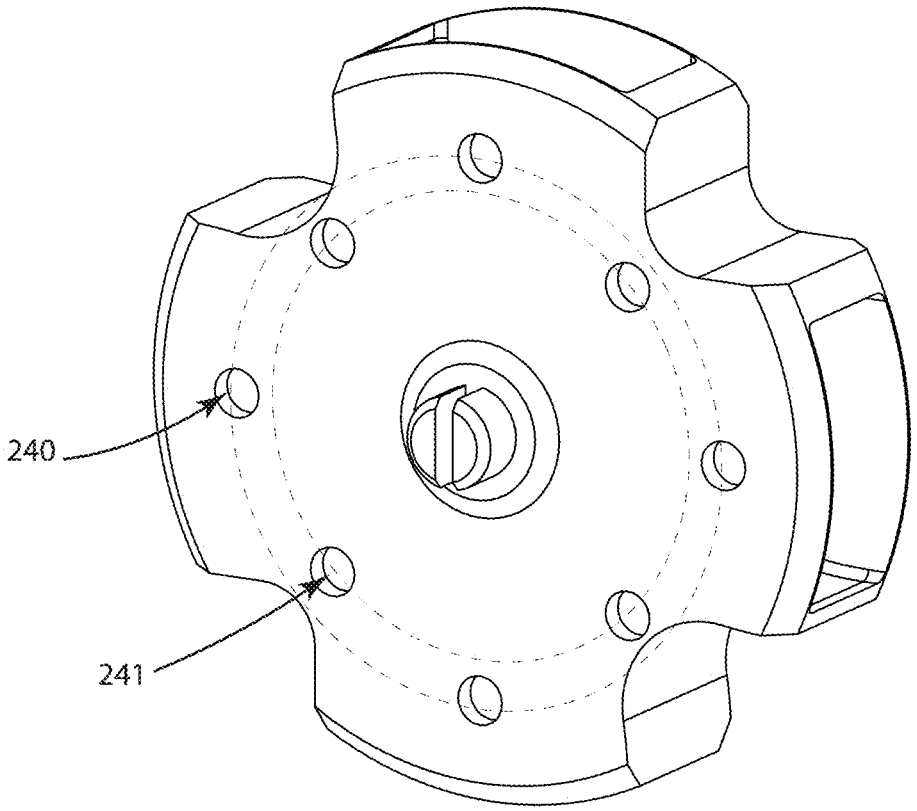
FIG. 6 is a rear-perspective view of example 2-pol rotor of FIG. 3.

Referring to FIGS. 5 and 6, dashed lines group components that are arranged in an array. An array may be any number of components arranged in a pattern. An example is an array of four permanent magnets 232 that are joined by a dashed line in FIG. 5.

A frame 210 has a cover 212 that in combination houses a rotor 221 that rotates about a horizontal axis 209 on bearings 234 and 236.

The rotor 221 has transmission-path openings 224, 226, 228 and 230 that align, in one configuration, with transmission-path ports 214, 216 218 and 220. In an example embodiment, a transmission path resides between openings 224 and 230 while a second transmission path resides between openings 226 and 228. An array of electromagnets 231 engages an array of permanent magnets 232 to rotate the rotor. One skilled in the art understands that use of electromagnets in conjunction with permanent magnets placed on a rotor of the disclosed embodiment and iterations, essentially renders the switch a motor with RF paths embedded in its rotor. The array of magnets 232 are embedded in holes 241 (FIG. 6) on the rear of the rotor 221. One skilled in the art understands how switching the polarity of electromagnets to attract or repel magnets in the array 232 may effectively spin the rotor 221.

A second array of magnets 239 (FIG. 5) is embedded in holes 240 (FIG. 6) on the rear of the rotor 221. The array of magnets 239 aligns with reed switches 211 (FIG. 5) which are housed in the frame 210. Magnets in the array 239 flip reed switches 211 when in close proximity. One skilled in the art understands how the movement of magnets past the reed switches 211 flips each reed switch, signaling the relative rotational position of the rotor 221.

Magnets 237 are mounted in holes 250 in the front of the rotor 221. Corresponding magnets 235 are mounted in the cover 212. The magnets represented by 235 and 237 are used as detents to ensure the rotor stops and locks in proper position for port alignment. In the example embodiments, magnets are shown mounted in specific holes. One skilled in the art is familiar with alternative methods of packaging magnets in an apparatus for providing a similar function.

Figure 7:
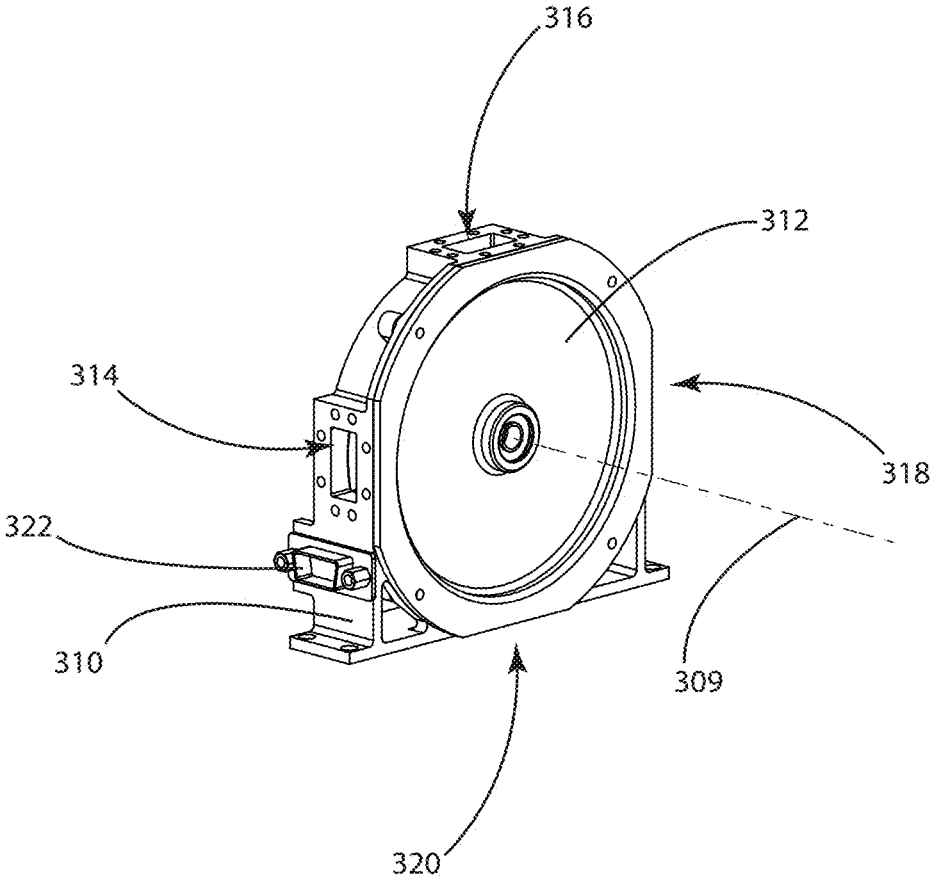
FIG. 7 is a front-perspective view of an iteration of a 3-pol design.

FIG. 7 shows an example embodiment 300 of an iteration of a waveguide switch of the present embodiment. A frame 310 has transmission-path ports 314, 316, 318 and 320. Ports 318 and 320 are visible in FIG. 8; one skilled in the art understands that similar perpendicular ports may reside on any side of a frame such as frame 310. A cover 312 contains a rotor 321 (FIG. 8) that rotates about a horizontal axis 309. An electrical port 322 communicates with a processor for telemetry and actuation, measuring the orientation of the rotor 321 (FIG. 8) and for actuating the electromagnets 331 mounted to the frame 310.

Figure 8:
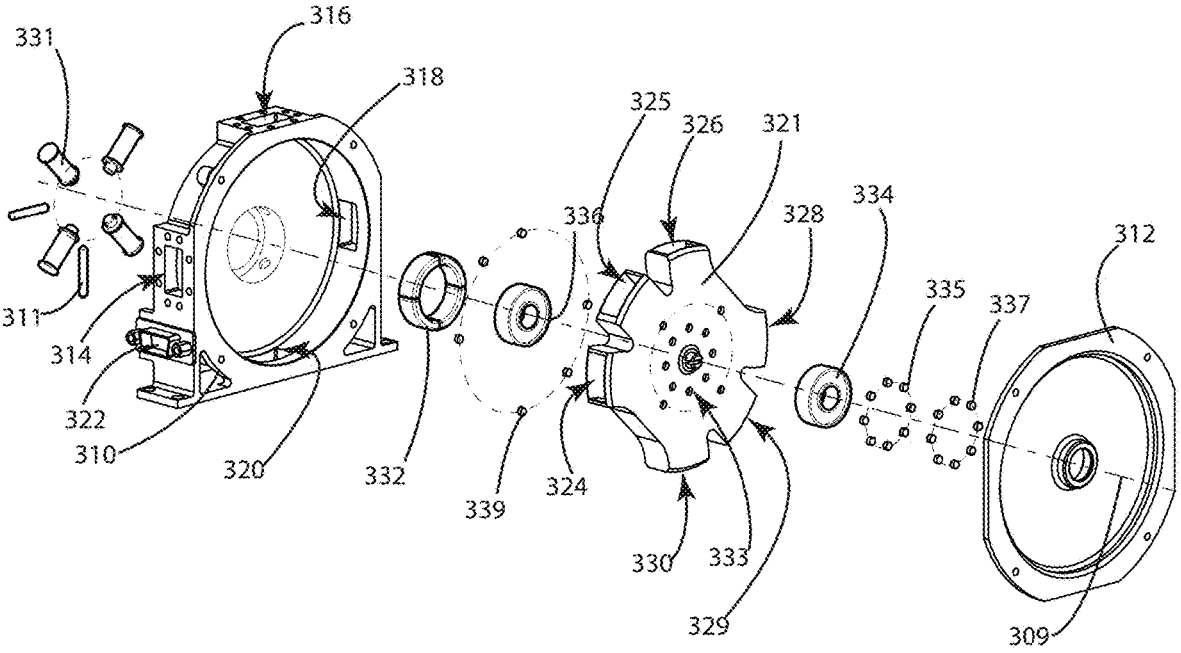
FIG. 8 is a front-perspective, exploded view of the FIG. 7 iteration of a 3-pol design.
Figure 9:
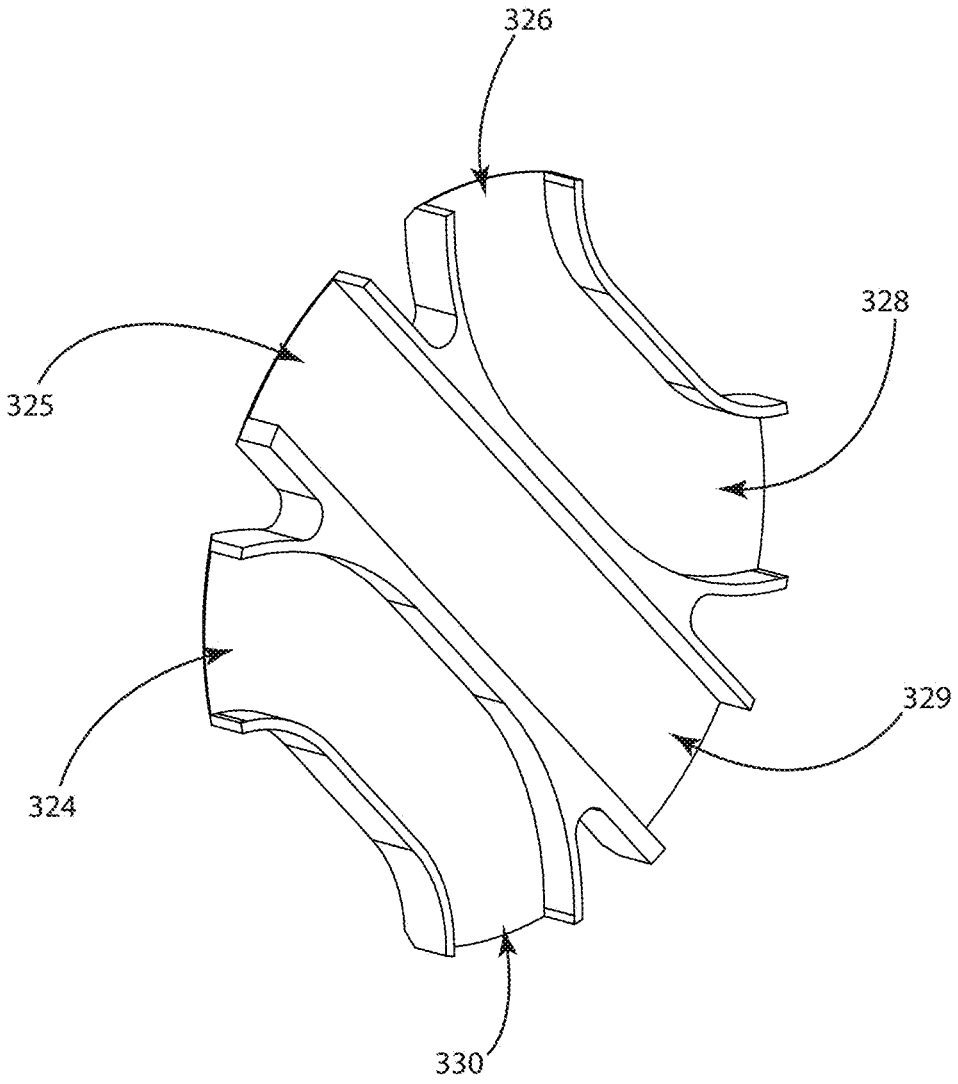
FIG. 9 is a perspective, section view of an example 3-pol rotor of the FIG. 7 iteration.
Figure 10:
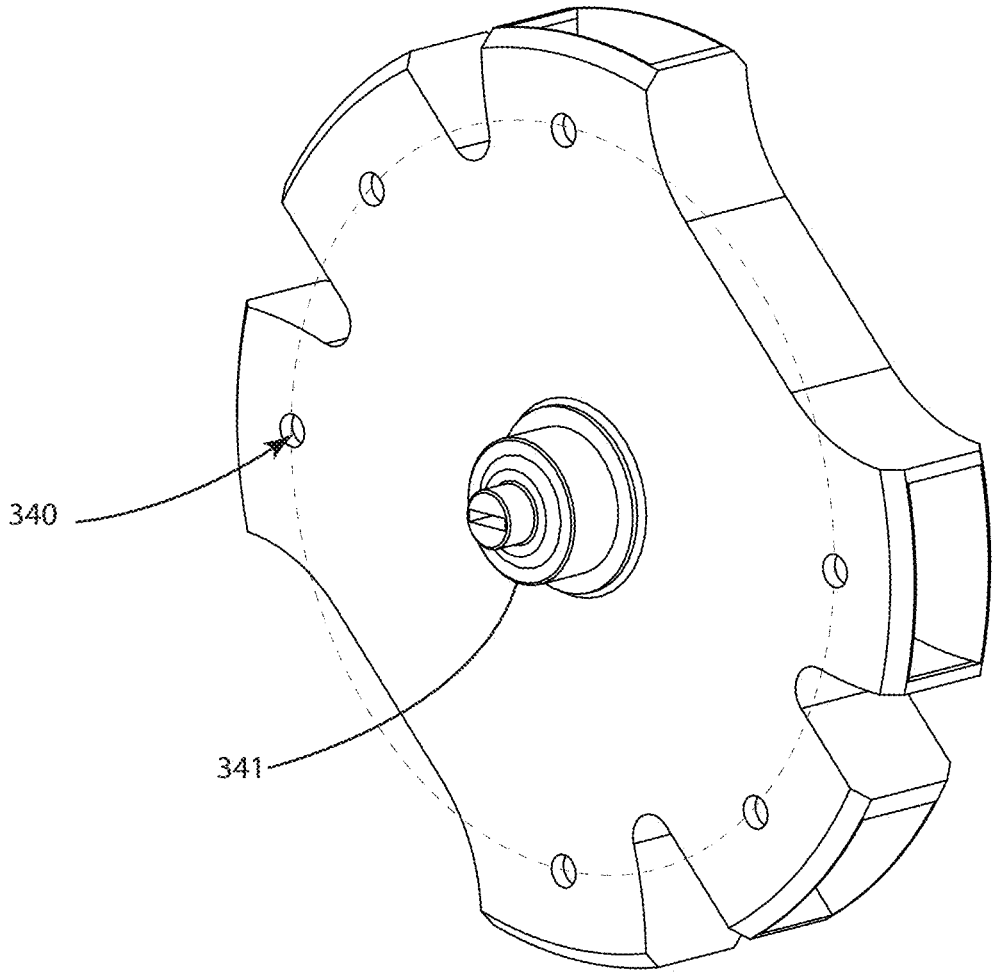
FIG. 10 is a rear-perspective view of example 3-pol rotor of FIG. 7.

FIG. 8 is an exploded, perspective view of the example embodiment of FIG. 7. FIG. 9 is a perspective, section view of a rotor 321. FIG. 10 is a rear perspective view of a rotor 321.

Referring to FIGS. 8 and 10, dashed lines in FIG. 8 encircle components that are grouped in an array. An array may be any number of components arranged in a pattern. For example, in FIG. 8 an array of magnets 339 is a group of magnets joined by a dashed line.

A frame 310 has a cover 312 that in combination houses a rotor 321 that rotates about the horizontal axis 309 on bearings 334 and 336.

The rotor has transmission-path openings 324, 325, 326, 328, 329 and 330 that align, in one configuration, with transmission-path ports 314, 316 318 and 320. In an example embodiment, a transmission path resides between openings 324 and 330 while a second transmission path resides between openings 326 and 328. A third transmission path resides between openings 325 and 329. One skilled in the art understands that in one configuration a transmission path between opening 326 and 328 may align with transmission ports 316 and 318 respectively; and that by rotating the rotor 321 approximately 45°, a transmission path may reside between opening 325 and 329 will then align with transmission ports 316 and 320, respectively.

An array of electromagnets 331 engages an array of permanent magnets 332 affixed to the rotor 321 (FIG. 10) about boss 341 to rotate the rotor. One skilled in the art understands how switching the polarity of electromagnets to attract or repel magnets in the array 332 may effectively spin the rotor 321.

A second array of magnets 339 is embedded in holes 340 at the rear of the rotor 321 (FIG. 10). The array of magnets 339 aligns with reed switches 311 that are housed in the frame 310. Magnets in the array 339 flip reed switches 311 when in close proximity. One skilled in the art understands how the movement of magnets past the reed switches 311 flips each reed switch, signaling the relative rotational position of the rotor 321.

Magnets 335 are mounted in holes 333 in the rotor 321. Corresponding magnets 337 are mounted in the cover 312. The magnets 335 and 337 are used as detents to ensure the rotor stops and locks in the appropriate position for proper port alignment.

Figure 11:
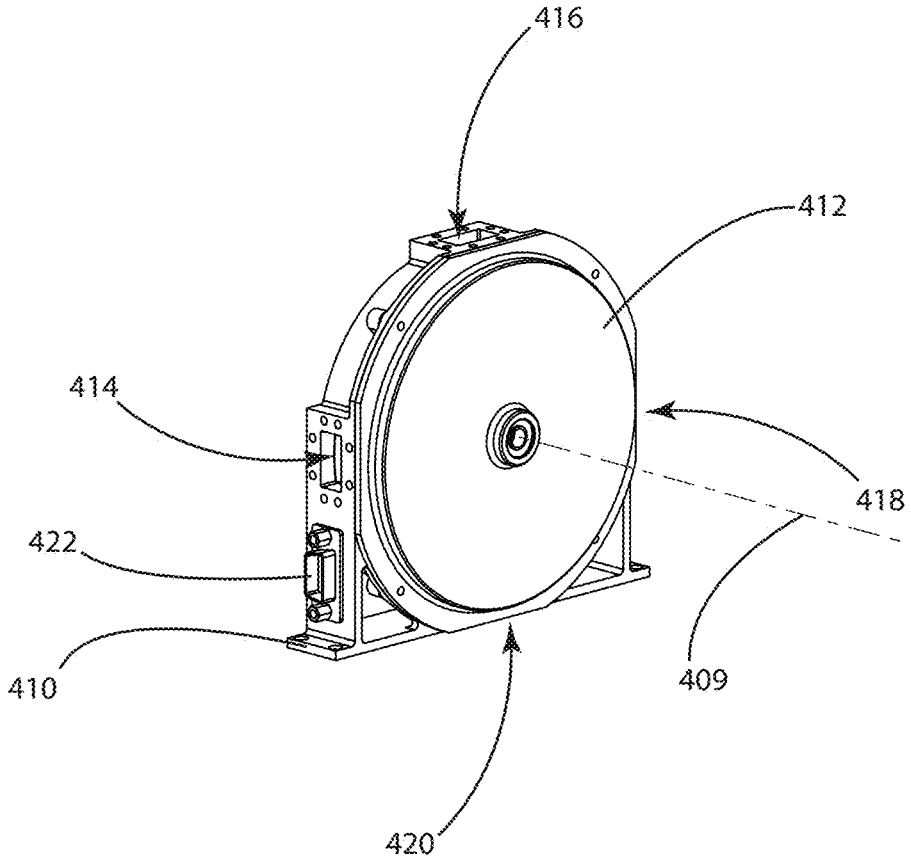
FIG. 11 is a front-perspective view of an iteration of a 4-pol design.

FIG. 11 shows an example embodiment 400 of an iteration of the embodiment. A frame 410 has transmission-path ports 414, 416, 418 and 420. Ports 418 and 420 are visible in FIG. 12. One skilled in the art understands that similar perpendicular ports may reside on any side of a frame such as frame 410.

Figure 12:
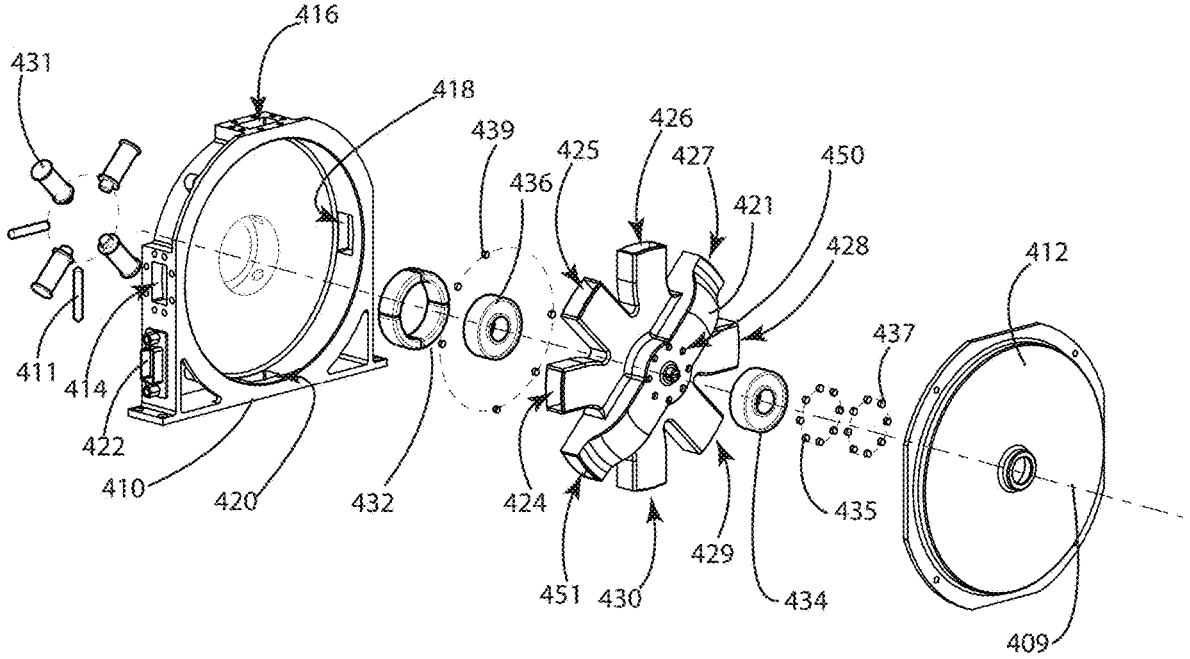
FIG. 12 is a front-perspective, exploded view of the iteration of FIG. 11 of a 4-pol design.

In FIG. 12, a cover 412 contains a rotor 421 which rotates about horizontal axis 409. An electrical port 422 communicates with a processor for telemetry and actuation, measuring the orientation of the rotor 421 and for actuating the electromagnets 431 mounted to the frame 410.

Figure 14:
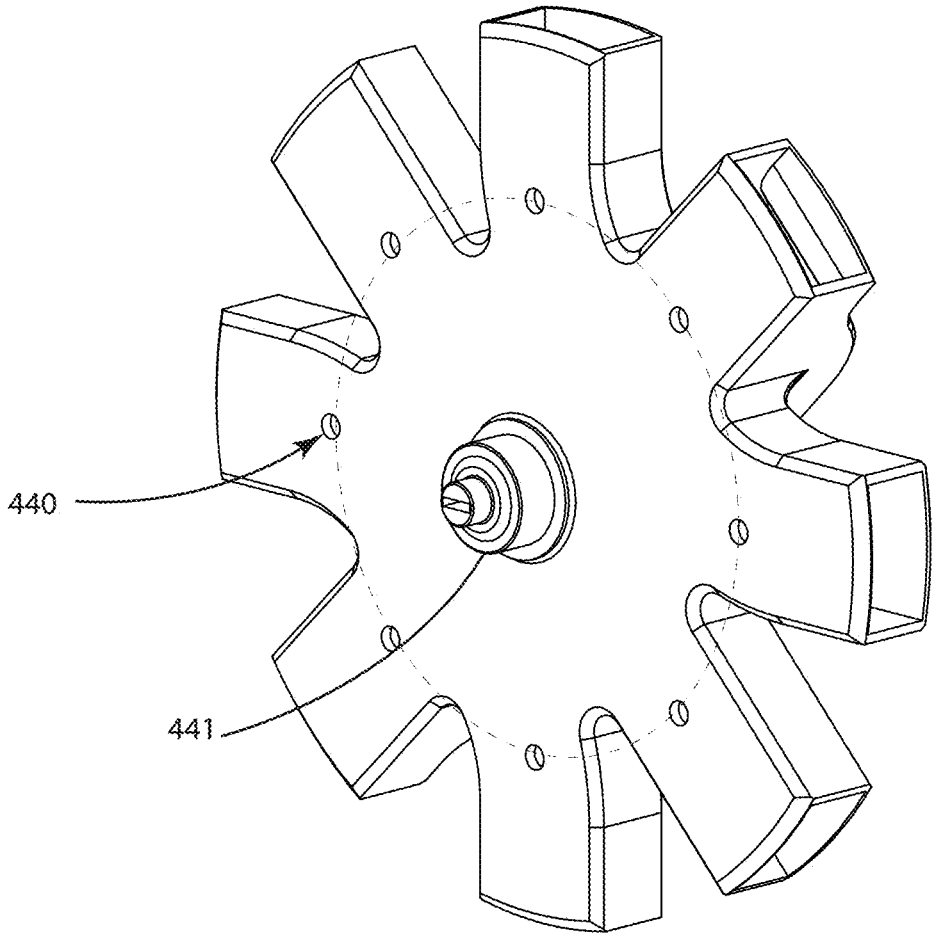
FIG. 14 is a rear-perspective view of example 4-pol rotor of the iteration of FIG. 11.

Referring to FIGS. 12 and 14, dashed lines group components in FIGS. 12 and 14 that are arranged in an array. An array may be any number of components arranged in a pattern. For example, in FIG. 12, an array of magnets 439 is a group of magnets joined by a dashed line.

Figure 13:
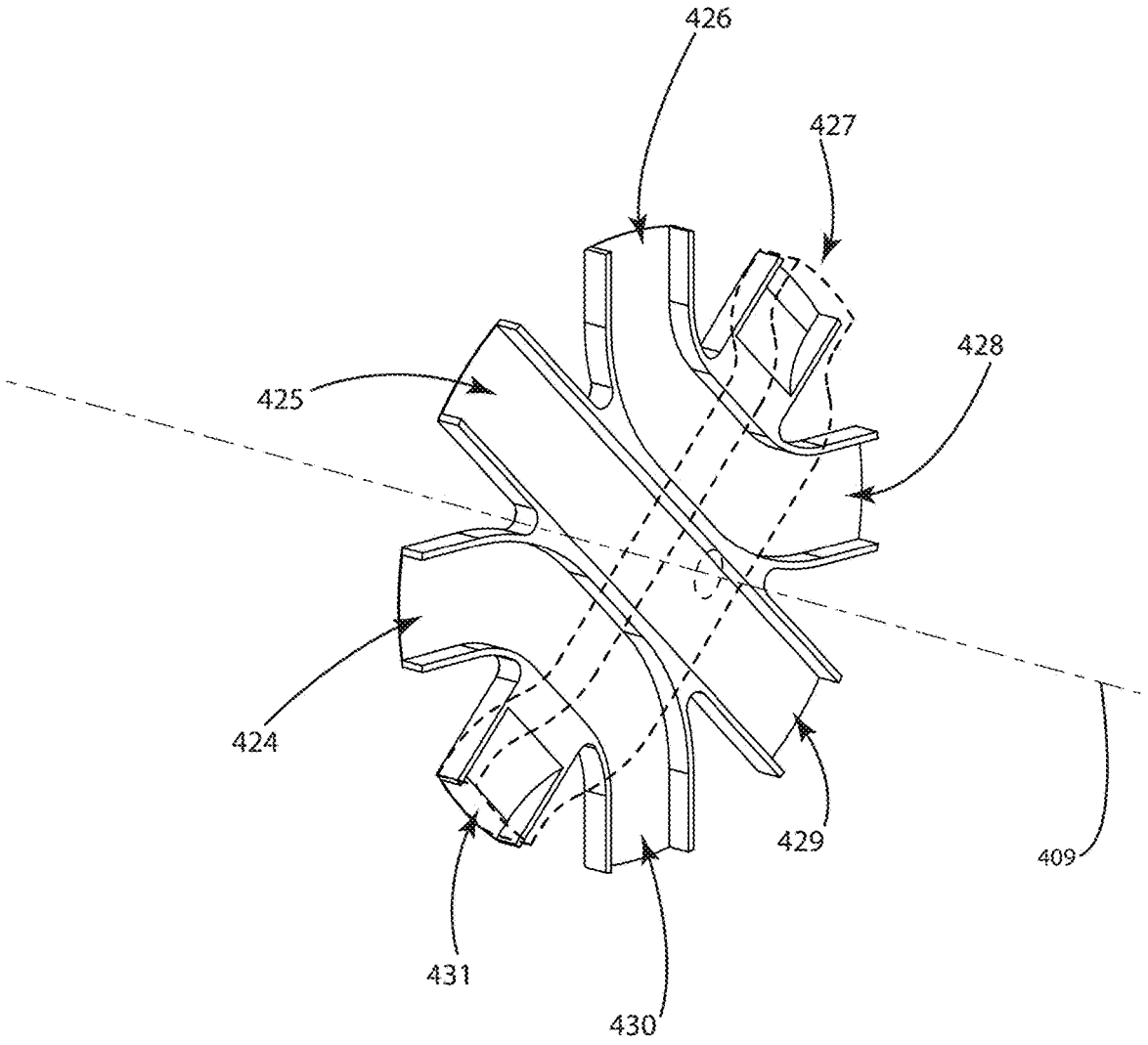
FIG. 13 is a perspective, section view of an example 4-pol rotor of the iteration of FIG. 11.

Referring to FIGS. 12, 13 and 14: a frame 410 has a cover 412 that together house a rotor 421 which rotates about horizontal axis 409 on bearings 432 and 434. The rotor has transmission-path openings 424, 425, 426, 427, 428, 429, 430 and 451 that, in one configuration, align with transmission-path ports 414, 416, 418 and 420. In an example embodiment, a transmission path resides between openings 424 and 430, between 425 and 429, between 426 and 428, and between openings 427 and 451. In FIG. 12, a transmission path entering transmission port 416 follows the transmission path between 426 and 428 and exits transmission port 418. A similar transmission path between 424 and 430 exists between transmission ports 414 and 420. One skilled in the art understands that by beginning in the illustrated orientation, and rotating the rotor 421 approximately 45°, a transmission path between opening 425 and 429 would align with transmission-path ports 416 and 420 respectively, while a second transmission path between openings 451 and 427 would align with transmission-path ports 414 and 418.

Referring to FIG. 13, it can be seen that the transmission path between openings 425 and 429 is perpendicular to the transmission path between openings 451 and 427. This is referred to as a primary orientation. Dashed lines in FIG. 13 describe a hidden component, or a part of the rotor 421 that would have been cut away in the perspective section view.

The following describes the four transmission paths provided by the rotor. The transmission path between openings 425 and 429 may be said to extend, in a primary orientation, from position 0° to position 180°. The transmission path between openings 426 and 428 may be said to extend, in a primary orientation, from 45° to 135°. The transmission path between openings 427 and 451 may be said to extend, in a primary orientation, 90° to 180°. The transmission path between openings 424 and 430 may be said to extend, in a primary orientation, from 225° to 315°. One skilled in the art understands that a rotation of the rotor 45° results in a change in direction to a transmission port 90° from the previously connected transmission port.

The rotor 421 is substantially disc-shaped and rotates about horizontal axis 409. One skilled in the art understands that a rotor said to be disk-shaped or substantially disk-shaped may be a disk with additional features such as receptacles for magnets or protrusions for additional transmission paths. In some embodiments, the openings, e.g., 451, are rectangular with the long edges of the rectangle(s) perpendicular to the axis of rotation 409. Waveguide switches of the state of the art commonly have cylindrical rotors with a vertical axis of rotation that is parallel to the long edge of rectangular openings. In other words, the orientation of the rotor 421 relative to the axis of rotation 409 in combination with the long edges of the transmission path openings being perpendicular to the axis of rotation 409 allow for a transmission path such as that between openings 451 and 427. One skilled in the art understands that the entire apparatus may be rotated so that the axis of rotation 409 is vertical, while providing similar features and functions.

It can be seen that the transmission path between openings 451 and 427 is shaped to bridge over the transmission path between opening 425 and 429, as it crosses perpendicularly.

An array of electromagnets 431 (FIG. 12) engages an array of magnets 432 affixed to the rotor about boss 441 (FIG. 14). One skilled in the art understands how switching the polarity of electromagnets to attract or repel magnets in the array 432 may effectively spin the rotor 421.

A second array of magnets 439 (FIG. 12) are embedded in holes 440 (FIG. 14) at the rear of the rotor 421. The array of magnets 439 aligns with reed switches 411 housed in the frame 412. Magnets in the array 439 flip reed switches 411 when in close proximity. One skilled in the art understands how the flipping of reed switches 411 as the array of magnets 439 come in close proximity to reed switches 411 may be used to determine the relative position of the rotor 421 with respect to transmission-path ports 414, 416, 418 and 420.

Magnets 435 are mounted in holes 450 in the rotor 421. Corresponding magnets 437 are mounted in the cover 412. The magnets represented by 335 and 337 are used as detents to stop the rotor and lock it in the proper position for port alignment.

Figure 15:
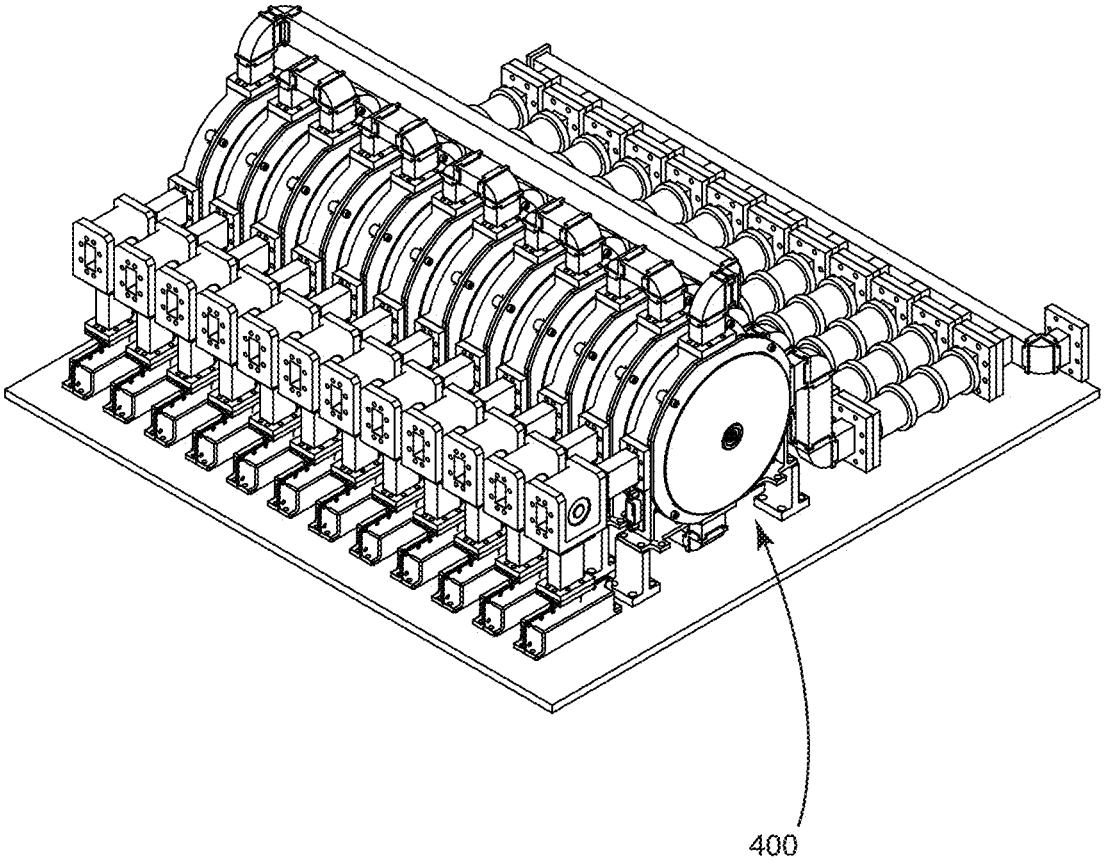
FIG. 15 is a perspective view of an example switch matrix of the present embodiment.

FIG. 15 shows a matrix with 12 waveguide switches. The matrix is considerably more compact than waveguide matrices of the state of the art, thus reducing mass and RF losses due to relatively shorter transmission paths. In a fault case, its compactness makes the fault's corrective route a shorter distance relative to switch matrices comprised of waveguide switches of the state of the art. A matrix comprised of switches of a 4-pol design of FIG. 11-FIG. 14, arranged in a similar matrix, enables additional capability, particularly in the recovery from a fault case. An example fault case recovery is described in the diagrams in FIGS. 16-19.

Figure 16:
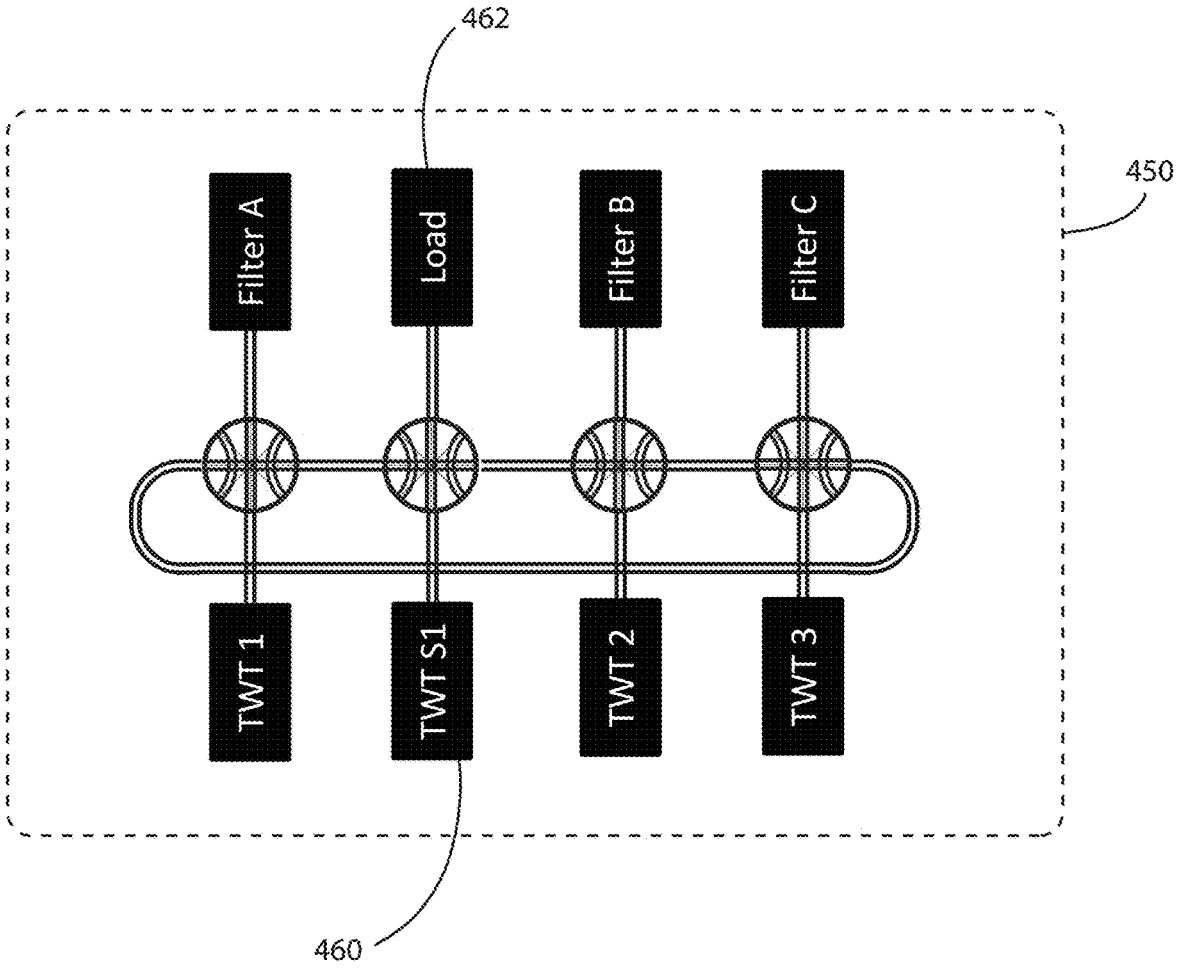
FIG. 16 is a diagram depicting a 4-pol switch scenario.

The diagram in FIG. 16 illustrates a standard case (also referred to as a common configuration). In the configuration 450, a transmission path flows straight through each waveguide switch, a common configuration when no fault has occurred. In the example, each traveling wave tube (TWT) is connected to its corresponding filter. A redundant, or spare, traveling wave tube labeled TWT S1 460 is connected to an RF load 462. TWTs are used as an example; one skilled in the art understands that other equipment may also be used.

Figure 17:
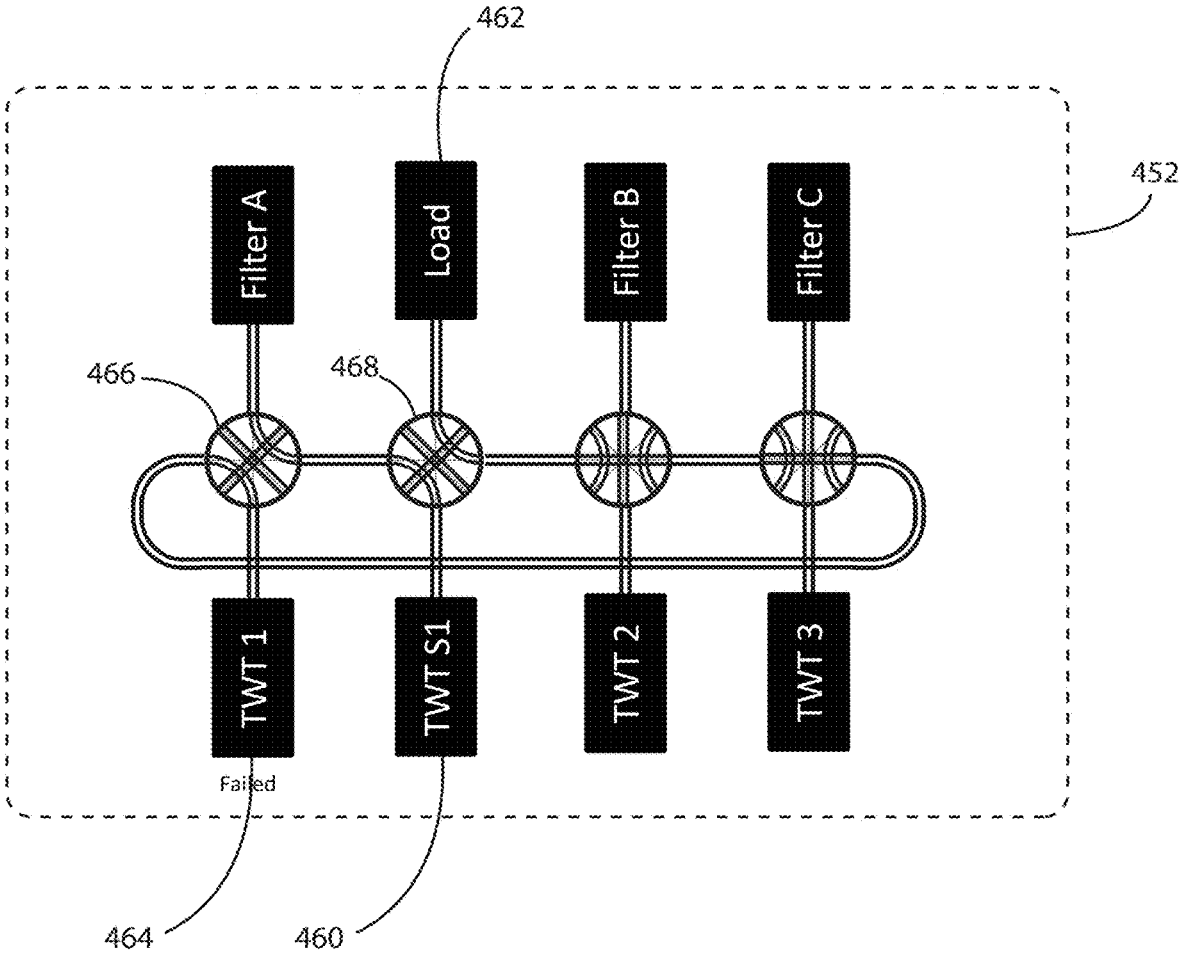
FIG. 17 is a diagram depicting a 4-pol switch fault-case scenario.

The diagram in FIG. 17 illustrates a fault case 452 in which TWT-1 464 has been replaced with TWT-S1 460. In the diagram, TWT1 464 has failed and a first switch 466 and second switch 468 have been rotated approximately 45° counterclockwise so that unit TWT1 464 is replaced with TWTS1 460. The unit TWT1 464 now has a path to the RF Load 462. One skilled in the art understands that running such a unit to a load will allow the absorption of any RF energy to be dissipated to heat as required 462.

Figure 18:
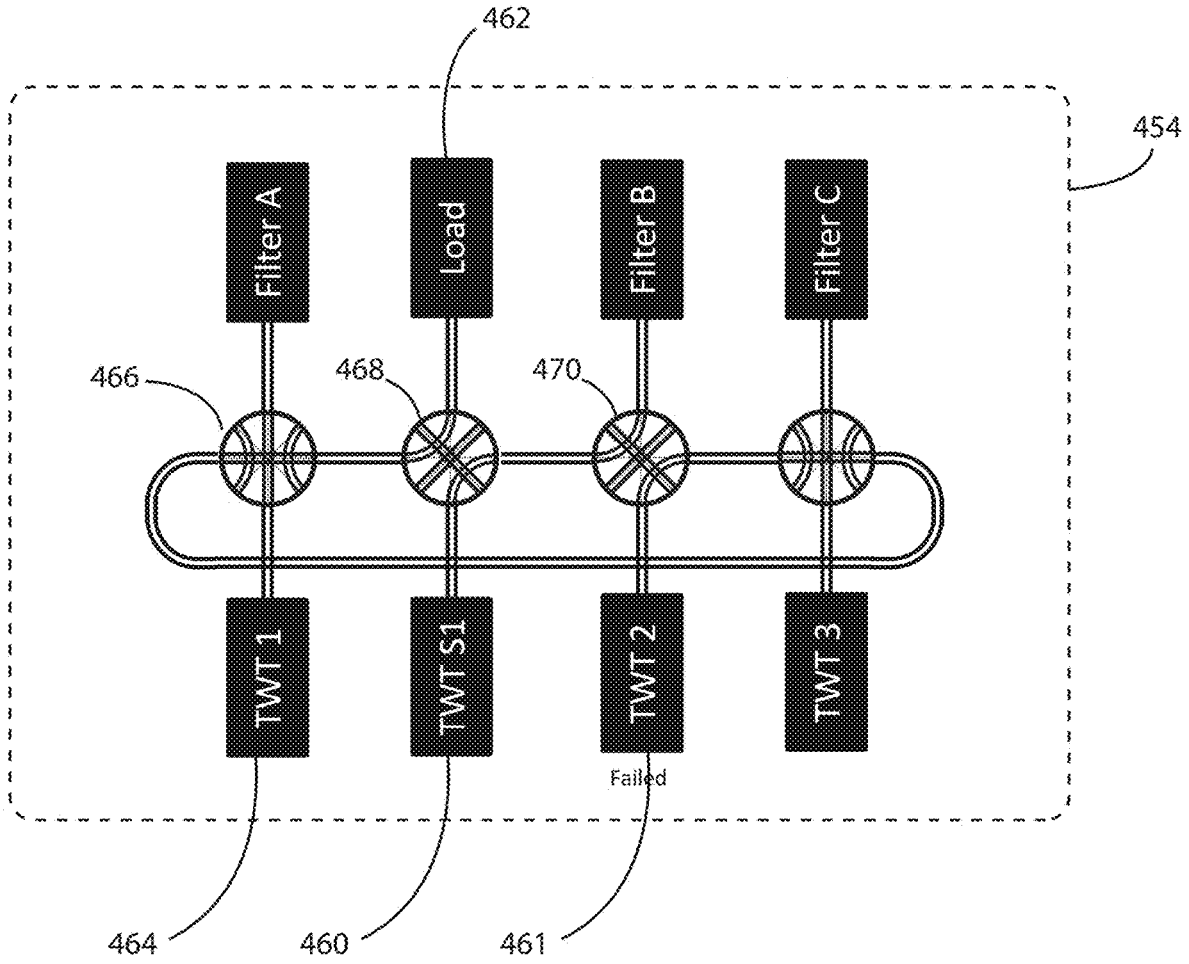
FIG. 18 is a diagram depicting another 4-pol switch fault-case scenario.

The diagram in FIG. 18 illustrates a second fault case. In this example TWT2 461 has failed. To recover from the fault case, a second switch 468 and a third switch 470 have been rotated approximately 45° clockwise so the unit TWT2 461 is replaced with TWTS1 460. In the example, the failed unit TWT2 461 has been routed to the RF load 462.

Figure 19:
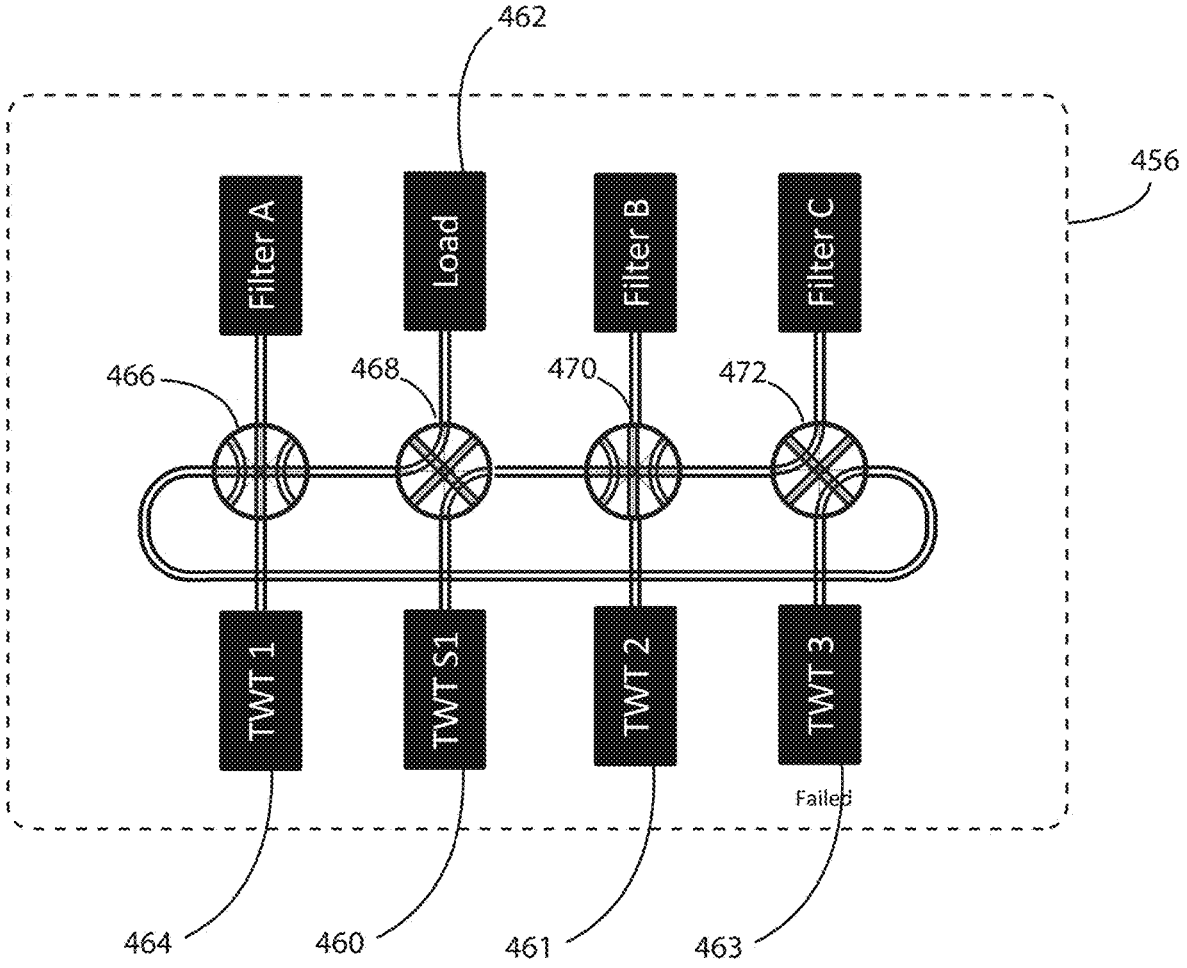
FIG. 19 is a diagram depicting yet another 4-pol switch fault-case scenario.

The diagram in FIG. 19 illustrates a third fault case. In this example TWT3 463 has failed. To recover from the fault case, a second switch 468 and a fourth switch 472 have been rotated approximately 45° in a clockwise direction such that the unit TWT3 463 is replaced with TWTS1 460. In the example, the failed unit is routed to the RF load 462. In this case the spare TWTS1 460 is able to replace TWT3 463 directly with little or no impact to adjacent equipment.

One skilled in the art understands that the diagrams in FIGS. 16-19 describe example embodiments and configurations of a redundancy scheme. In practice, there may be many primary and redundant units. As the system grows the number of switches increases, resulting in a complicated switch matrix and waveguide paths.

Figure 20:
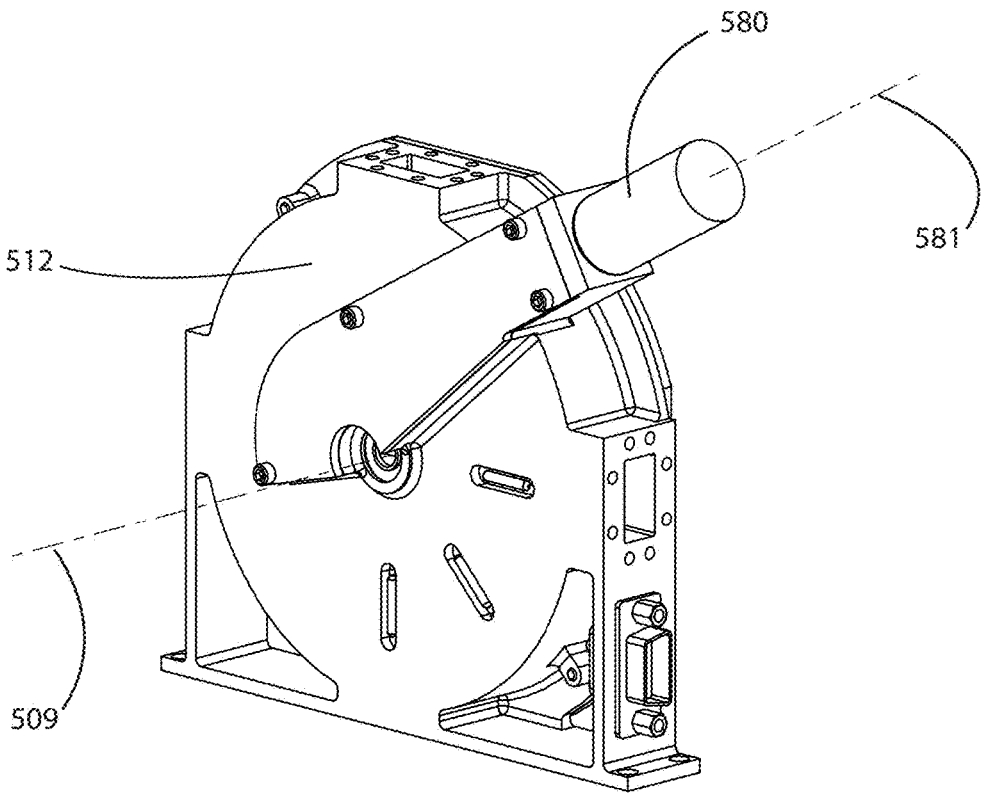
FIG. 20 is a perspective view of an iteration of the embodiment with a solenoid actuator engaged with a 4-pol switch.

In FIG. 20 an iteration of the embodiment employs an actuator engaged with a rotor with an actuator shaft that is out of plane with the switch rotor axis. In other words an actuator shaft axis is not parallel with the rotational axis of a switch rotor axis.

Figure 21:
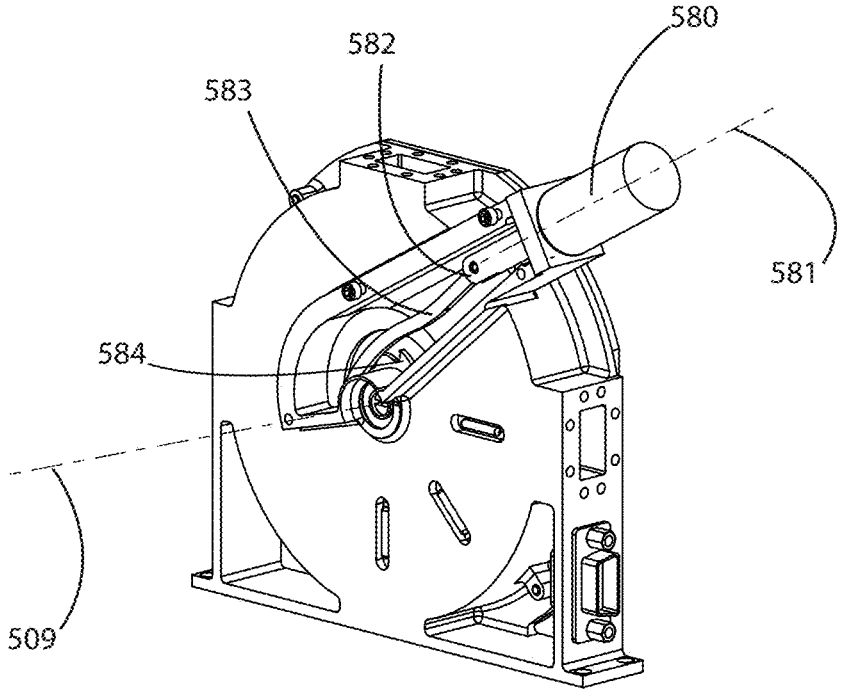
FIG. 21 is a perspective, cutaway view of the interior of the iteration of FIG. 20.

FIG. 20 is a perspective view of an iteration of the embodiment being a 4-pol switch 500 having a rotor axis of rotation 509, the rotor contained in a housing 512. FIG. 21 is an illustration of the interior of the embodiment 500. Referring to FIG. 20 and FIG. 21, a solenoid actuator 580 has shaft axis 581 and is mounted on the housing 512. The actuator shaft axis 581 is not parallel to the switch rotor axis 509. The solenoid actuator shaft 582 is connected to a linkage 583 that moves a gear 584 to rotate the switch rotor about the switch rotor axis 509. One skilled in the art understands that the embodiment 500 is similar to the aforementioned embodiments with the adaptation of the solenoid actuator 580. One skilled in the art understands that a solenoid actuator may be employed to rotate a 2-pol or 3-pol rotor equally.

Figure 22:
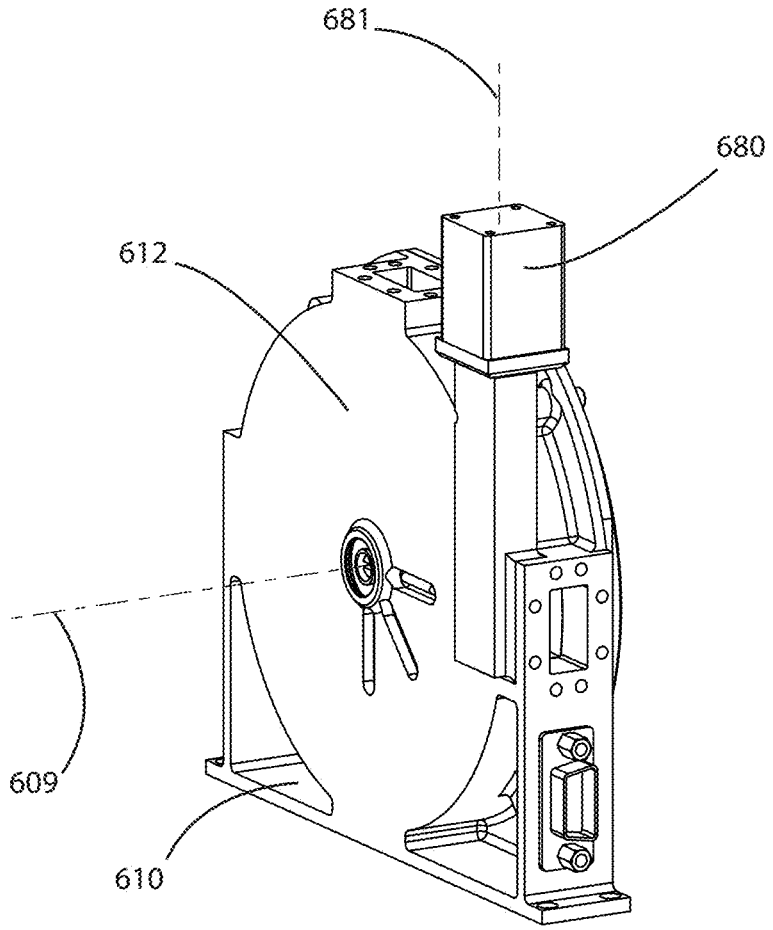
FIG. 22 is a perspective view of another iteration of the embodiment with a stepper motor engaged with a 4-pol switch.
Figure 23:
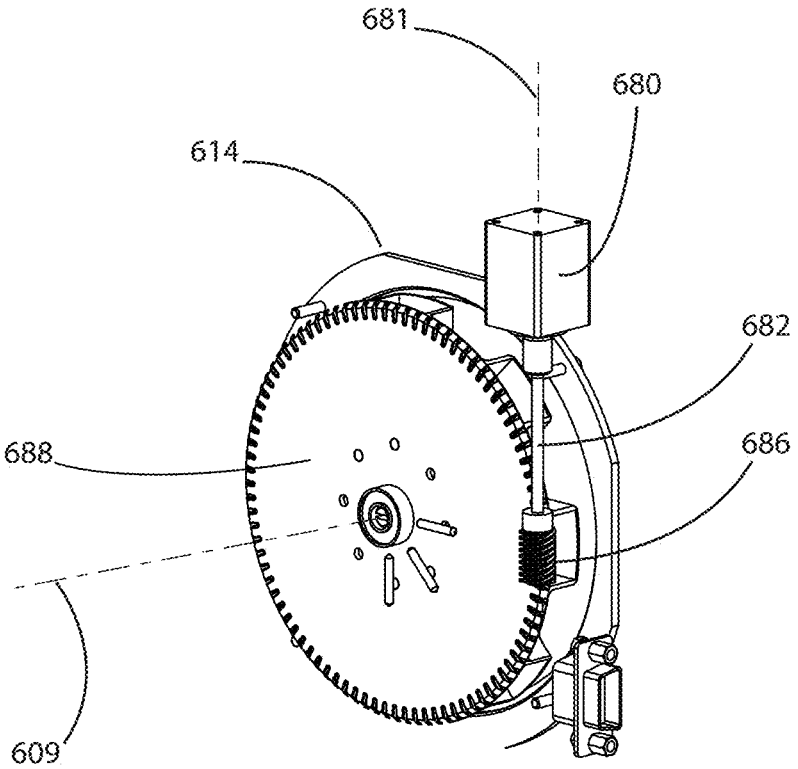
FIG. 23 is a perspective view of the interior of the iteration of FIG. 22.
Figure 24:
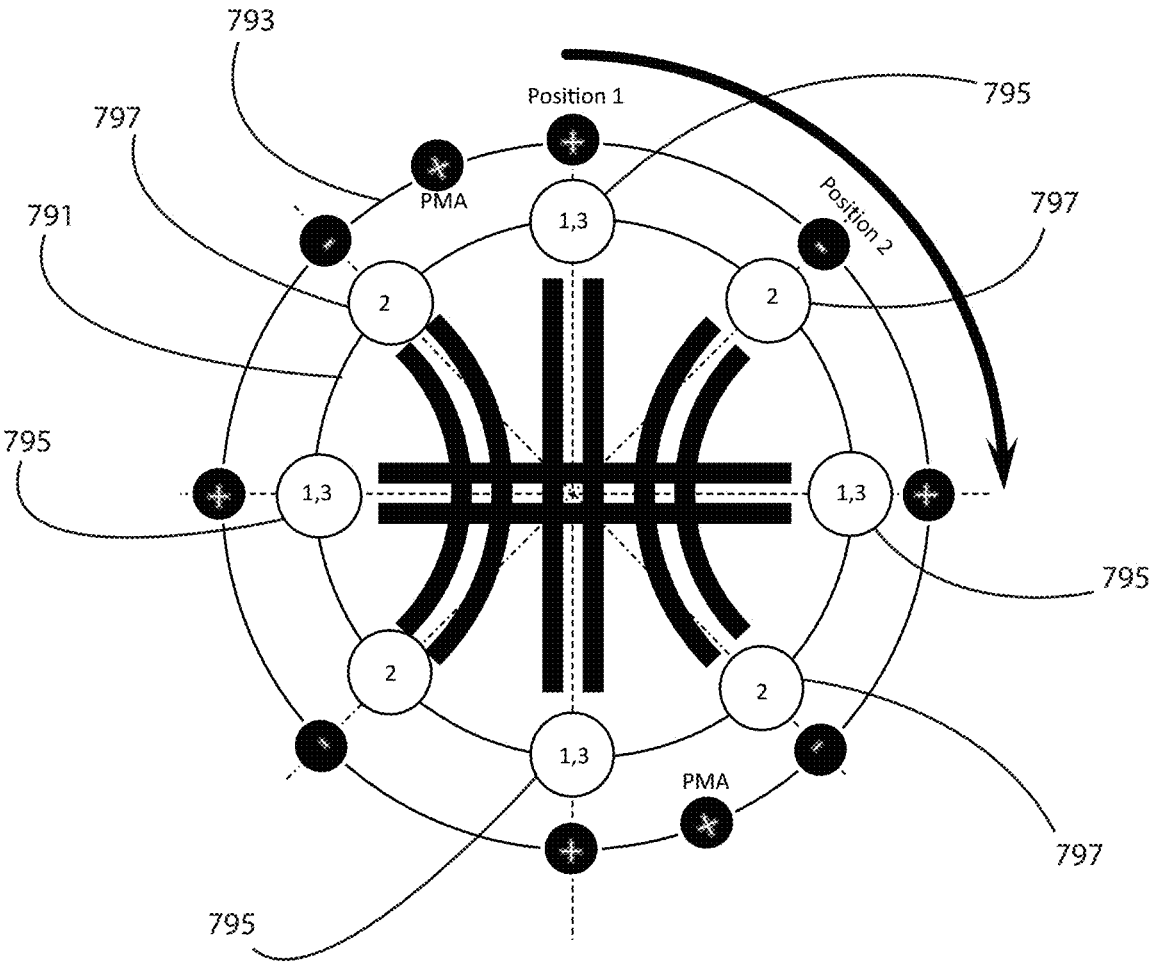
FIG. 24 is a diagram depicting the relationship between electromagnets and embedded permanent magnets.

FIG. 22 is a perspective view of an iteration of the embodiment being a 4-pol switch 600 having a rotor axis of rotation 609, the rotor contained in a housing 612. FIG. 23 is an illustration of the interior of the embodiment 600. Referring to FIGS. 22 and 23, a stepper motor actuator 680 has shaft axis 681 and is mounted on housing 614. The actuator shaft axis 681 is not parallel to the switch rotor axis 609. The stepper motor actuator shaft 682 is connected to a worm gear 686 that drives a gear 688 to rotate the switch rotor about the switch-rotor axis 609. One skilled in the art understands that gear teeth may be added to a rotor to form a gear. One skilled in the art understands that the embodiment 600 is similar to the aforementioned embodiments with the adaptation of the stepper motor actuator 680. One skilled in the art also understands that a stepper motor actuator may be employed to rotate a 2-pol or 3-pol rotor equally FIG. 24 is a diagram depicting the relationship between an array of electromagnets 791 and an array of embedded permanent magnets 793. In an example embodiment, electro-magnet (EM) 1 and EM 3 795 are pulsed for a given duration while EM 2 797 is pulsed for half the duration and the opposite polarity, wherein EMs 1, 2 and 3 each repel the nearest permanent magnet (PM). EM 1 is pulsed such that it also repels Permanent Magnet A (PMA), while at the same time EM2 is pulsed such that it attracts PMA, thus preventing reverse rotation.

Figure 25:
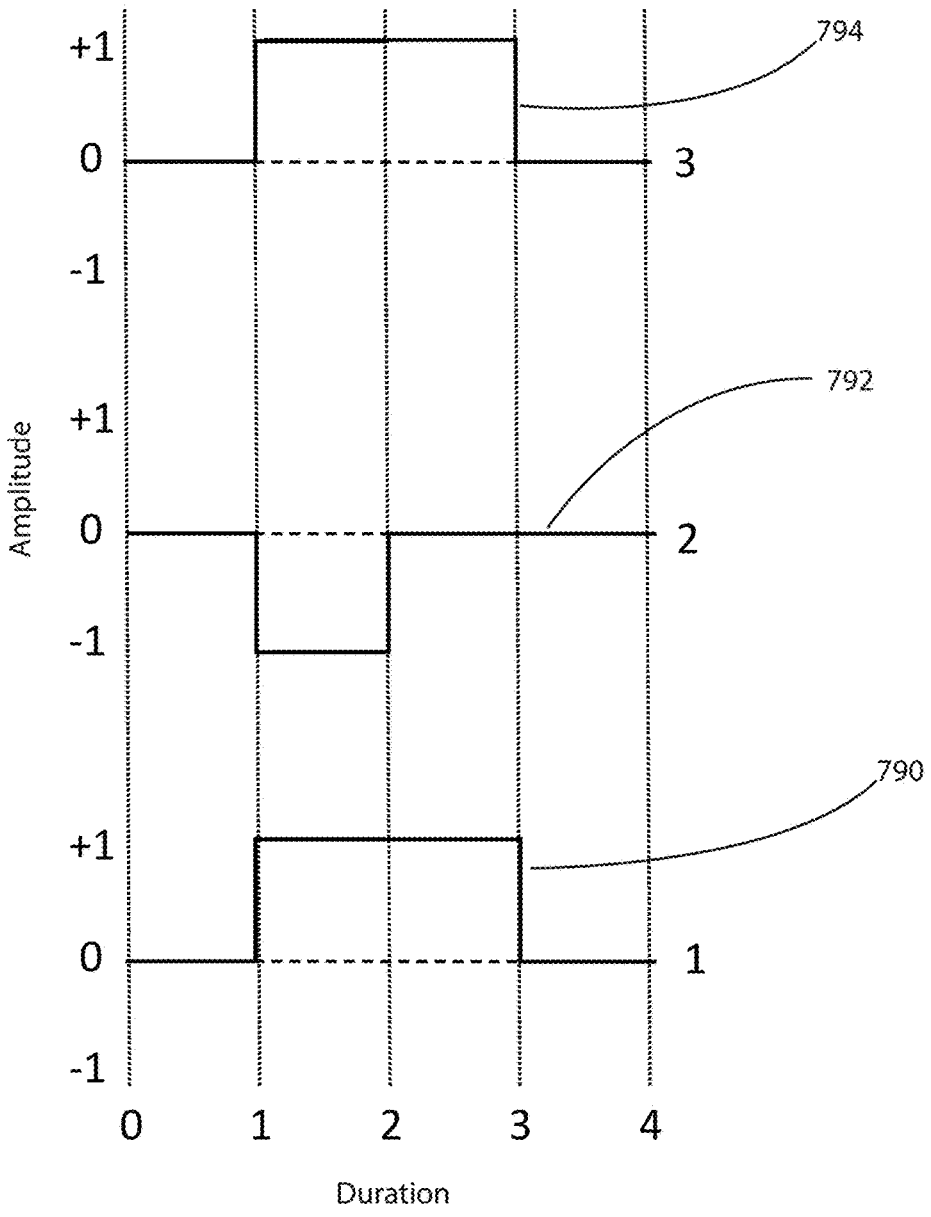
FIG. 25 is a diagram depicting the duration and amplitude of electric pulses sent through electromagnets to engage permanent magnets in a rotor to rotate the rotor.

FIG. 25 is a diagram depicting the duration and amplitude of electric pulses sent through electromagnets to permanent magnets in a rotor to rotate it. The pulse width and power amplitude applied to EMs are varied by a control system to ensure that each EM is pushing or pulling rotor magnets to support rotation in a specified direction, while none of the Ems work against the specified direction as the rotor rotates. In one example, the duration of the EM2 pulse 792 has half the duration and the opposite polarity of EM3 pulse 794 or EM1 pulse 790 so that it attracts the PMA (FIG. 20).

Example embodiments described herein are expressly written so as not to limit the scope of the invention. Described features are not mutually exclusive and can exist in various combinations and permutations, even if not made express herein.

The invention claimed is:

1. A waveguide switch comprising:

a frame having a base and at least four transmission ports; and a central axis parallel to said base; and a rotor having at least two transmission paths configured to align with said transmission ports; and said rotor housed in said frame and configured in a vertical orientation, coaxial with said central axis; wherein the rotor in a vertical orientation reduces the space requirement for said waveguide switch.

2. The waveguide switch of claim 1 wherein:

said at least four transmission ports are located at 0°, 90°, 180°, and 270°; and the rotor comprising:

four transmission paths each extending from a first transmission port to a second transmission port; and when oriented in a primary position, a first transmission path extends between a first transmission port and a third transmission port, along a linear path from 0° to 180°; and a second transmission path forms a right angle between 45° and 135°; and a third transmission path forms a right angle between 225° and 315°; and a fourth transmission path extends along a linear path from 90° to 180° and bridges said first, second and third transmission paths; wherein a 45° rotation of said rotor alters the transmission path by 90°.

3. The waveguide switch of claim 1 further comprising:

an array of electromagnets fixedly engaged with said frame about said central axis and magnetically coupled with at least a first array of permanent magnets; and said at least a first array of permanent magnets fixedly engaged with said rotor and rotationally engaged with said frame about said central axis; and a controller for sending electrical impulses to each of said electromagnets in said array; wherein the electrical impulses sent to each of said electromagnets acts upon said at least a first array of permanent magnets, to move the rotor about the central axis and to change the alignment of said at least two transmission paths with said transmission ports.

4. The waveguide switch of claim 3 further comprising:

an array of reed switches electrically coupled with said controller fixedly engaged with said frame proximal to said array of electromagnets; and at least a second array of permanent magnets fixedly engaged with said rotor about said central axis, magnetically coupled with said reed switches; and said controller configured to receive signals from said reed switches; wherein the movement of permanent magnets past said reed switches, flips each reed switch, a signal from each reed switch sent to said controller, signals the relative rotational position of said rotor.

5. A waveguide switch comprising:

a frame having a base and at least four transmission ports; and a central axis parallel to said base; and a rotor having at least two transmission paths configured to align with said transmission ports; and said rotor housed in said frame and configured in a vertical orientation, coaxial with said central axis; and an array of at least four electromagnets fixedly engaged with said frame about said central axis and magnetically coupled with a first array of permanent magnets; and said first array of permanent magnets fixedly engaged with said rotor and rotationally engaged with said frame about said central axis; and a controller for sending electrical impulses to each of said electromagnets in said array; and an array of reed switches electrically coupled with said controller fixedly engaged with said frame proximal to said array of electromagnets; and at least a second array of permanent magnets fixedly engaged with said rotor about said central axis, magnetically coupled with said reed switches; and said controller configured to receive signals from said reed switches; wherein the electrical impulses sent to each of said electromagnets acts upon said first array of permanent magnets, to move the rotor about the central axis and to change the alignment of said at least two transmission paths with said transmission ports, and the movement of permanent magnets past said reed switches, flips each reed switch, a signal from each reed switch sent to said controller, signals the relative rotational position of said rotor.

6. The waveguide switch of claim 5 further comprising:

a third array of permanent magnets fixedly engaged with said rotor about said central axis and not magnetically coupled with said second array of permanent magnets; and a fourth array of permanent magnets fixedly engaged with said frame; about said central axis; aligned and magnetically coupled with said third array of permanent magnets; wherein said third array of permanent magnets couple with said fourth array of permanent magnets when said rotor transmission paths align with said transmission ports.

7. The waveguide switch of claim 5 further comprising:

said rotor being substantially disk shaped; and said at least two transmission paths being rectangular, having two relatively long edges and two relatively short edges; and said two relatively long edges perpendicular to the central axis; and said at least four transmission ports being rectangular and configured to align with said rectangular transmission paths; wherein the orientation of the rectangular transmission paths and transmission ports in combination with said substantially disk shaped rotor, provides a waveguide switch that occupies a relatively small space.

* * * * *